US009752432B2

(12) United States Patent
Smits

(10) Patent No.: US 9,752,432 B2
(45) Date of Patent: Sep. 5, 2017

(54) METHOD OF FORMATION EVALUATION WITH CLEANUP CONFIRMATION

(71) Applicant: Schlumberger Technology Corporation, Sugar Land, TX (US)

(72) Inventor: Anthony Smits, Yokohama (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 785 days.

(21) Appl. No.: 14/023,390

(22) Filed: Sep. 10, 2013

(65) Prior Publication Data

US 2015/0068734 A1 Mar. 12, 2015

(51) Int. Cl.
*E21B 49/08* (2006.01)
*E21B 49/10* (2006.01)

(52) U.S. Cl.
CPC ..... *E21B 49/10* (2013.01); *E21B 2049/085* (2013.01)

(58) Field of Classification Search
CPC ..... E21B 2049/085; E21B 49/10
USPC ..... 73/152.24
See application file for complete search history.

(56) References Cited

U.S. PATENT DOCUMENTS 5,201,220 A * 4/1993 Mullins ..... E21B 47/102 250/269.1
5,586,027 A * 12/1996 Carlson ..... G01N 33/2823 702/12
6,274,865 B1 8/2001 Schroer et al.
6,301,959 B1 10/2001 Hrametz et al.
6,719,049 B2 * 4/2004 Sherwood ..... E21B 49/10 166/252.5
7,458,252 B2 12/2008 Freemark et al.
7,757,760 B2 * 7/2010 Sherwood ..... E21B 49/10 166/100
8,024,125 B2 9/2011 Hsu et al.
8,047,286 B2 * 11/2011 Zazovsky ..... E21B 49/10 166/100
8,109,140 B2 * 2/2012 Tustin ..... E21B 49/10 73/152.24

(Continued)

OTHER PUBLICATIONS

O'Keefe et al., "Focused Sampling of Reservoir Fluids Achieves Undetectable Levels of Contamination," Apr. 2008, SPE Reservoir Evaluation & Engineering, pp. 205-218.*

(Continued)

*Primary Examiner* — John Fitzgerald
(74) *Attorney, Agent, or Firm* — Trevor G. Grove

(57) ABSTRACT

Methods of evaluating a downhole fluid with a downhole tool. The downhole tool is positionable in a wellbore penetrating a subterranean formation, and has a probe positionable adjacent a wall of the wellbore and pumps, the probe having a sampling inlet and a contamination inlet to draw fluid from the formation into the downhole tool with the pumps. The methods involve pumping fluid into the downhole tool through the sampling inlet and the contamination inlet, varying the pumping of the fluid through the sampling inlet and the contamination inlet at a plurality of flow rates, measuring parameters of the fluid passing through the sampling inlet and the contamination inlet (the fluid parameters comprising optical density), and determining cleanup of contamination during sampling by examining changes in optical density of the fluid entering the sampling inlet at the flow rates.

19 Claims, 7 Drawing Sheets

(56) References Cited

U.S. PATENT DOCUMENTS

| | | | | |
|---|---|---|---|---|
| 8,322,416 | B2 | 12/2012 | Pop et al. | |
| 8,555,968 | B2 * | 10/2013 | Zazovsky | E21B 49/008 166/100 |
| 2002/0148353 | A1 | 10/2002 | Seeley | |
| 2003/0217845 | A1 * | 11/2003 | Sherwood | E21B 49/10 166/264 |
| 2004/0000433 | A1 * | 1/2004 | Hill | E21B 49/10 175/59 |
| 2005/0155760 | A1 * | 7/2005 | Hill | E21B 49/10 166/264 |
| 2006/0000603 | A1 * | 1/2006 | Zazovsky | E21B 49/10 166/244.1 |
| 2006/0042793 | A1 * | 3/2006 | Del Campo | E21B 49/10 166/264 |
| 2006/0076132 | A1 * | 4/2006 | Nold, III | E21B 49/10 166/264 |
| 2006/0117842 | A1 * | 6/2006 | Ramakrishnan | E21B 49/10 73/152.55 |
| 2008/0073078 | A1 * | 3/2008 | Sherwood | E21B 49/10 166/264 |
| 2008/0125973 | A1 * | 5/2008 | Sherwood | E21B 49/10 702/11 |
| 2009/0101339 | A1 * | 4/2009 | Zazovsky | E21B 49/10 166/250.01 |
| 2009/0314077 | A1 * | 12/2009 | Tustin | E21B 49/10 73/152.24 |
| 2010/0018704 | A1 | 1/2010 | Zazovssky et al. | |
| 2010/0175873 | A1 * | 7/2010 | Milkovisch | E21B 49/008 166/264 |
| 2010/0193187 | A1 | 8/2010 | Briquet et al. | |
| 2010/0218943 | A1 | 9/2010 | Nold, III et al. | |
| 2011/0284212 | A1 | 11/2011 | Tao et al. | |
| 2011/0284219 | A1 * | 11/2011 | Pomerantz | E21B 49/10 166/264 |
| 2011/0284227 | A1 * | 11/2011 | Ayan | E21B 43/16 166/307 |
| 2012/0053838 | A1 * | 3/2012 | Andrews | E21B 49/082 702/8 |
| 2012/0055242 | A1 * | 3/2012 | Tustin | E21B 49/10 73/152.24 |
| 2012/0132419 | A1 * | 5/2012 | Zazovsky | E21B 49/10 166/264 |
| 2013/0020077 | A1 | 1/2013 | Irani et al. | |
| 2013/0075088 | A1 * | 3/2013 | Milkovisch | E21B 49/008 166/250.01 |
| 2014/0352397 | A1 * | 12/2014 | Smits | E21B 49/10 73/1.02 |

OTHER PUBLICATIONS

Akkurt et al., "Focusing on Downhole Fluid Sampling and Analysis," Oilfield Review, pp. 4-19, Winter 2006-2007.*

International search report and written opinion for the equivalent PCT patent application No. PCT/US2014/054673 on Dec. 5, 2014.

P.S. Hammond, "One- and Two-Phse Flow During Fluid Sampling by a Wireline Tool," Transport in Porous Media 6, pp. 299-330, 1991.

A. Skibin, A. Zazovsky, "Self-Similarity in Contamination Transport to a Formation Fluid Tester During Cleanup Production," Transport in Porous Media 83, pp. 55-72, 2010.

A.H. Akram, f.r. Halford, A.J. Fitzpatrick, "A Model to Predict Wireline Formation Tester Sample Contamination," SPE Reservoir Eval. & Eng 2 (6) Dec. 1999, pp. 499-505.

O.C. Mullins, J. Schroer, Real-Time Determination of Filtrate Contamination During Openhole Wireline Sampling by Optical Spectroscopy, SPE 63071, Oct. 1-4, 2000.

A. Zazovsky, "Monitoring and Prediction of Cleanup Production During Sampling," SPE 112409, Feb. 13-15, 2008.

P. Weinheber, R. Vasques, "New Formation Tester Probe Design for Low-Contamination Sampling," SPWLA 47th Annual Logging Symposium, Jun. 4-7, 2006.

K. Hsu, P. Hegeman, C. Dong, R. R. Vasques, M. O'Keefe, M. Ardila, "Multichannel Oil-base Mud Contamination Monitoring Using Downhole Optical Spectrometer," SPWLA 49th Annual Logging Symposium, May 25-28, 2008.

M. O'Keefe, K.O. Eriksen, S. Williams, D. Stensland, R. Vasques, "Focused Sampling of Reservoir Fluids Achieves Undetectable Levels of Contamination," Apr. 2008, SPE Reservoir Evaluation & Engineering, SPE-101084-PA, 14 pages.

International Preliminary Report on Patentability issued in the related PCT application PCT/US2014/054673, dated Mar. 15, 2017 (9 pages).

* cited by examiner

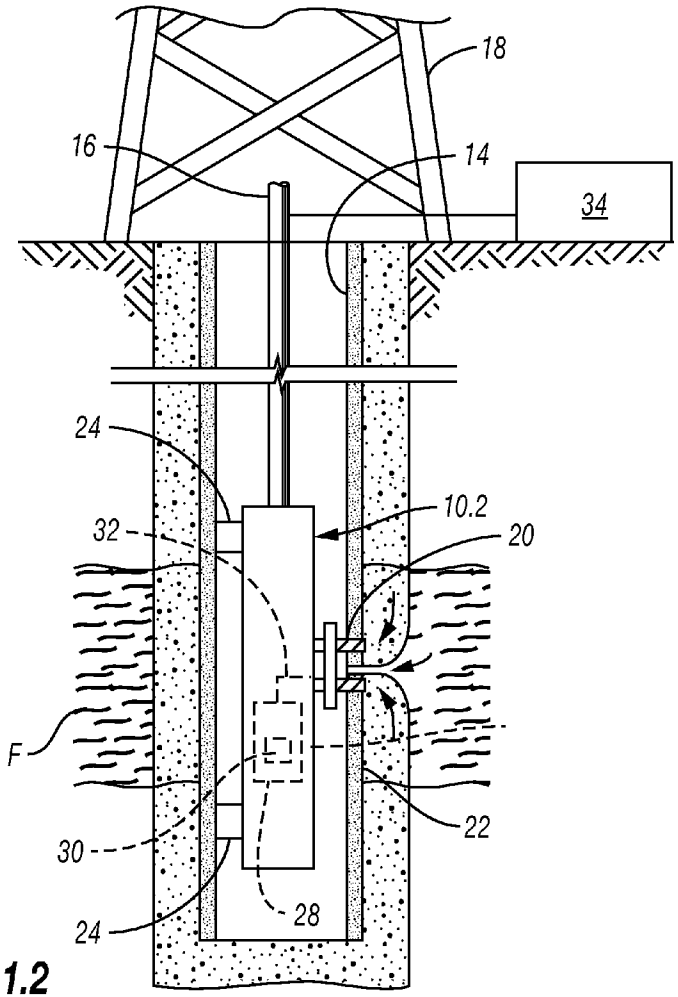
FIG. 1.2
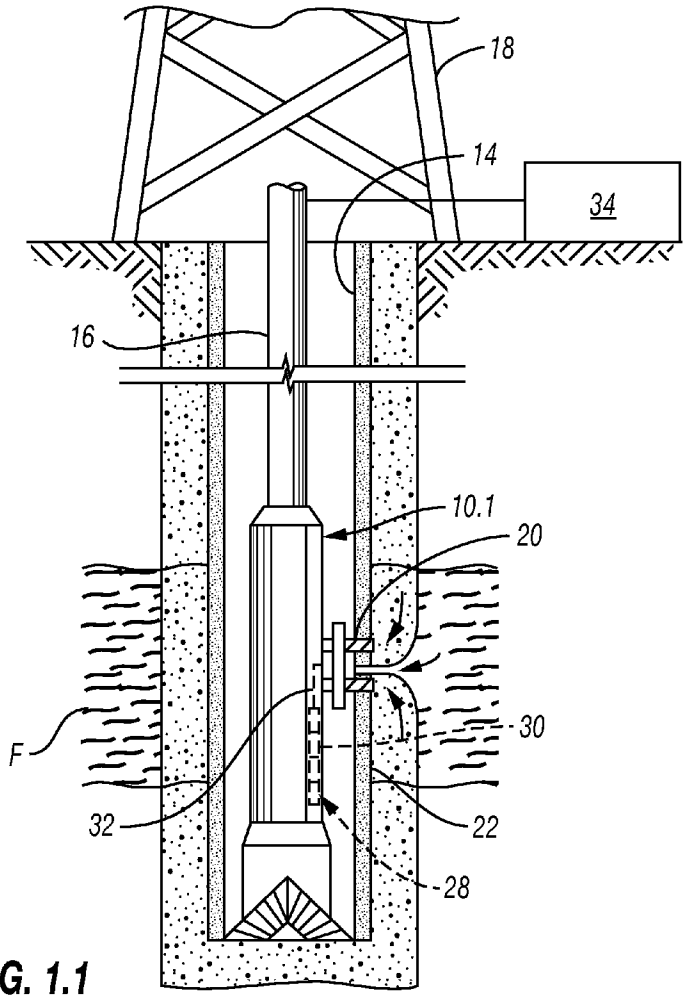
FIG. 1.1

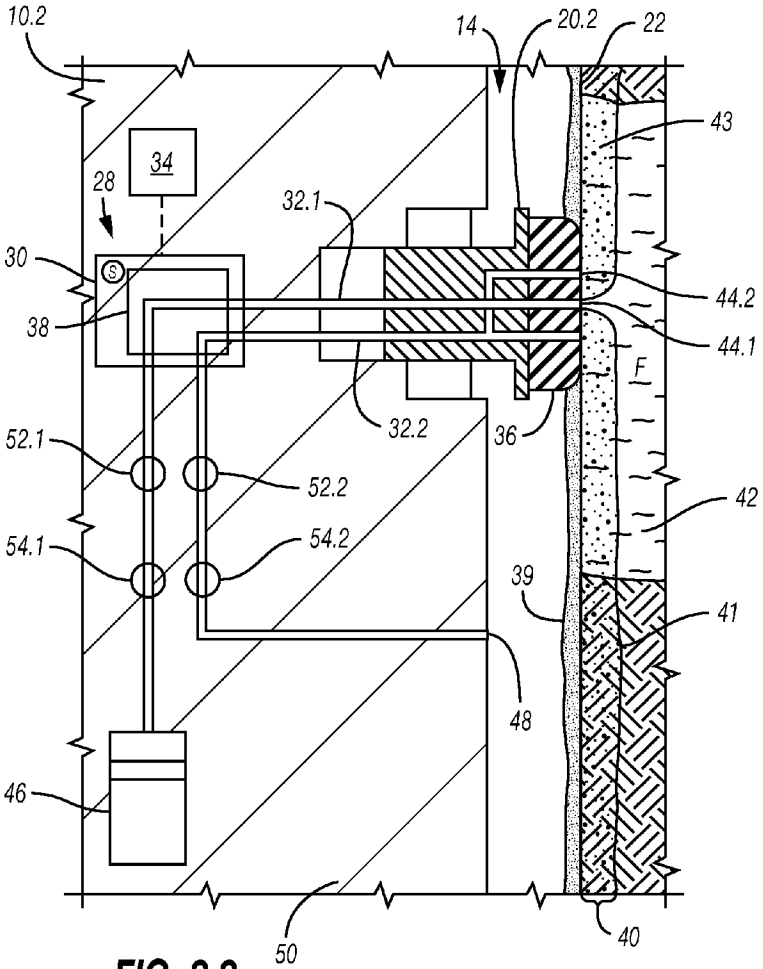
FIG. 2.2
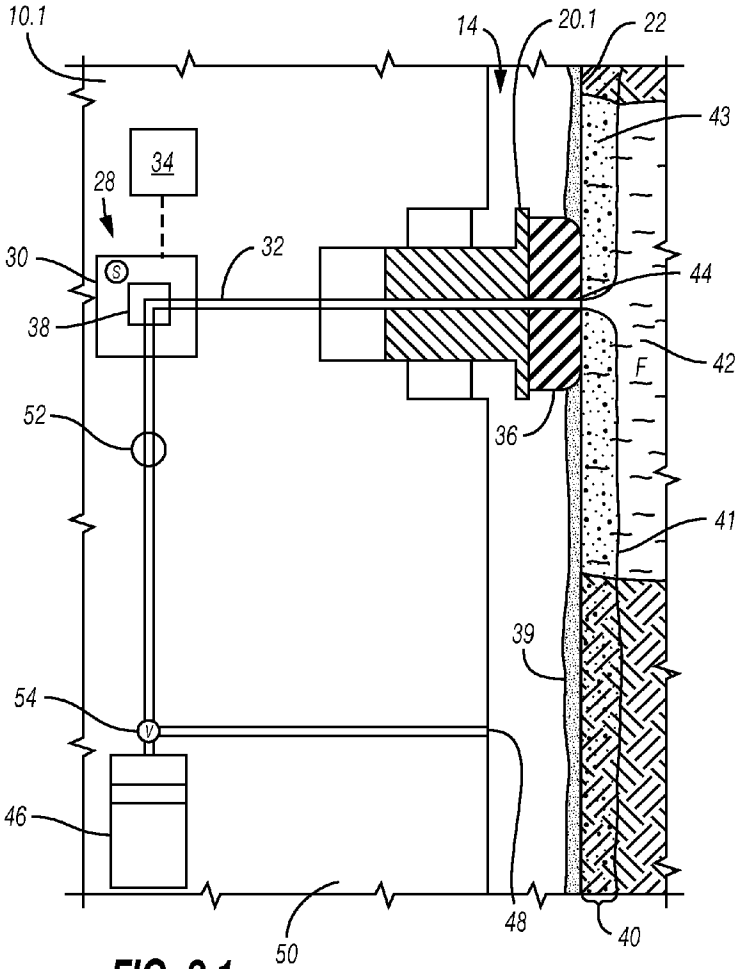
FIG. 2.1

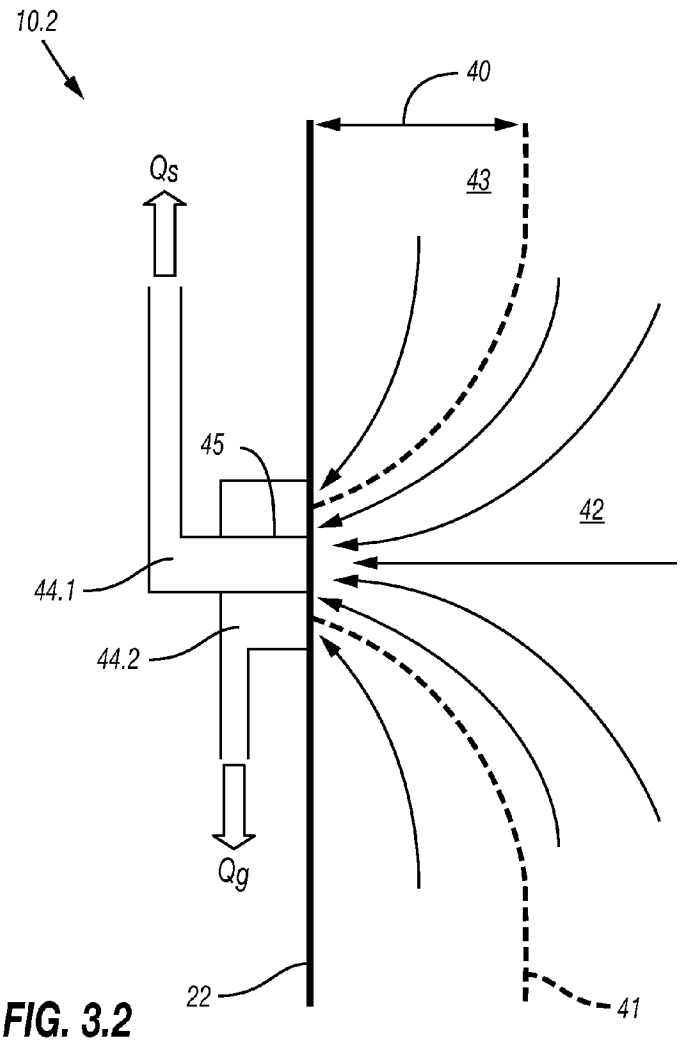
FIG. 3.2
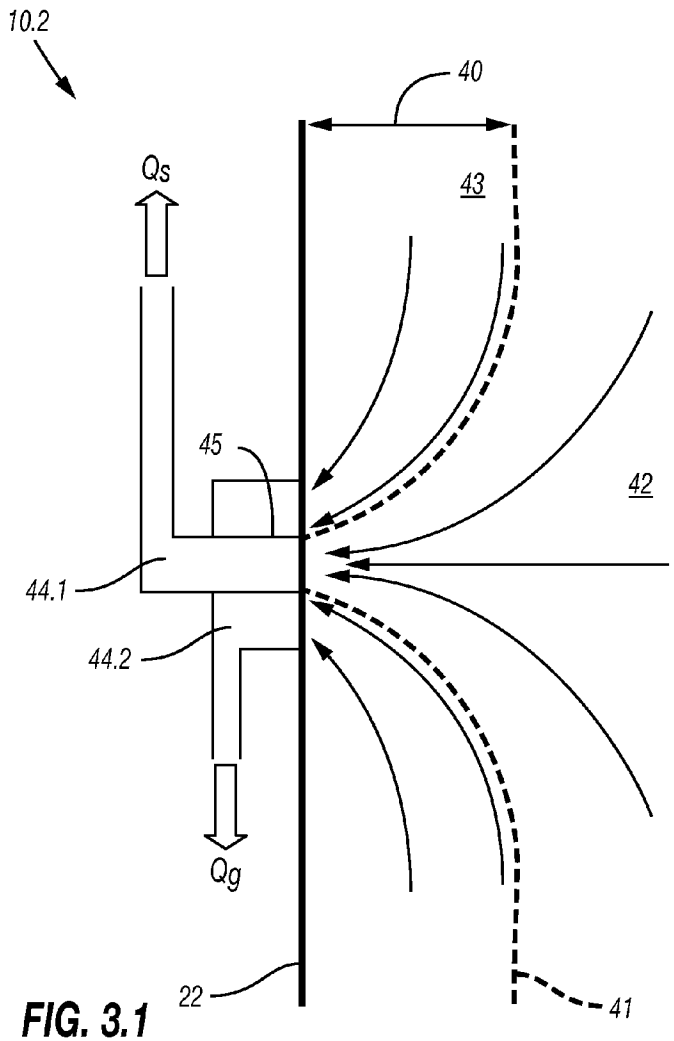
FIG. 3.1

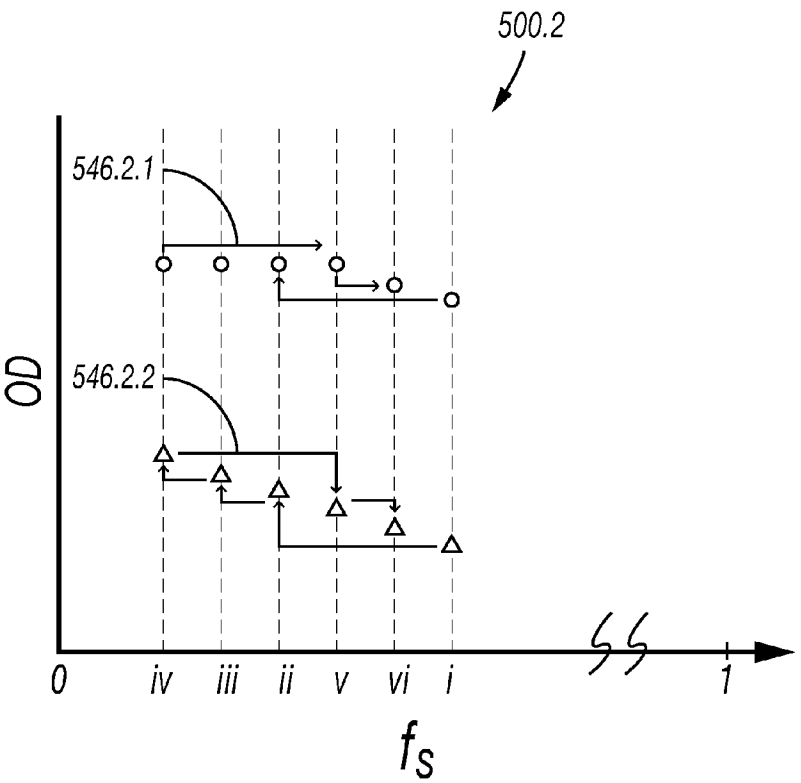
FIG. 5.2
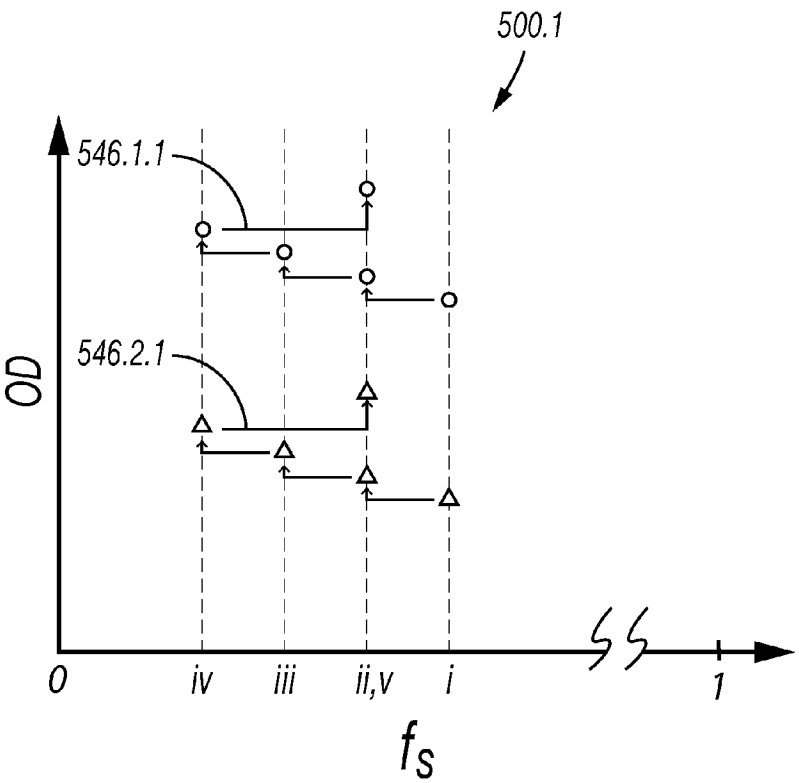
FIG. 5.1

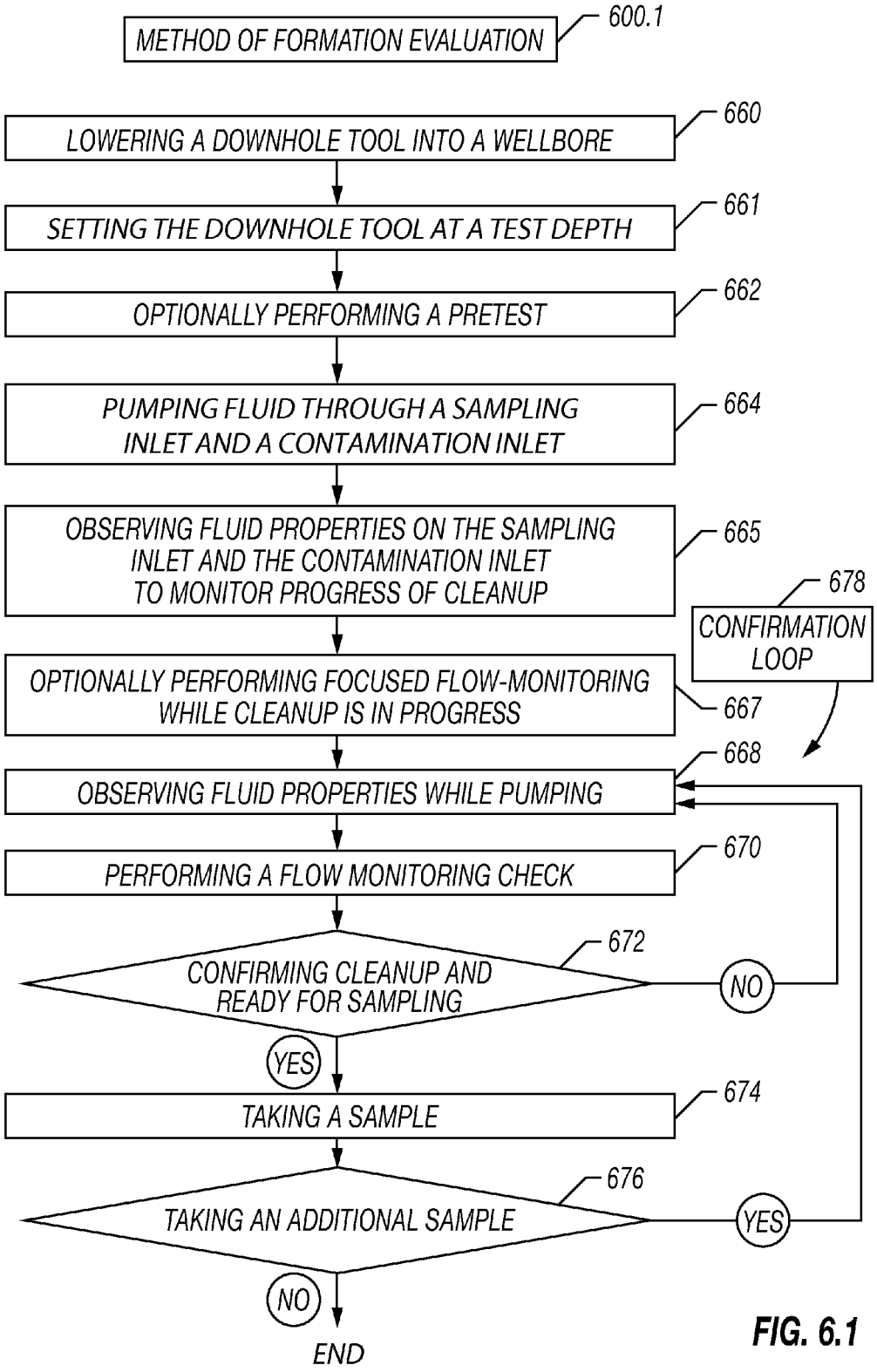
FIG. 6.1

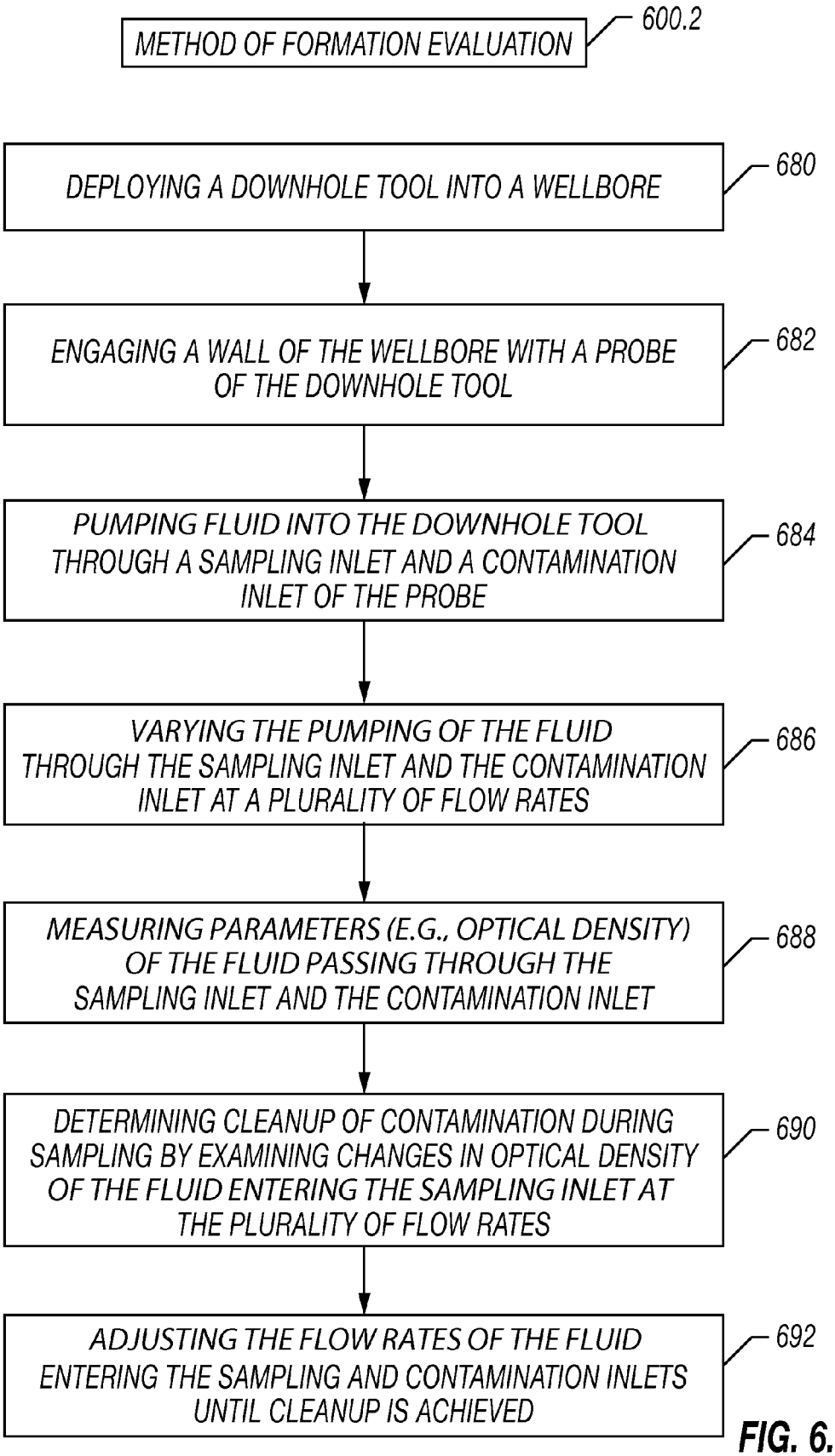
FIG. 6.2

METHOD OF FORMATION EVALUATION WITH CLEANUP CONFIRMATION

BACKGROUND

The present disclosure relates generally to wellsite operations. In particular, the present disclosure relates to formation evaluation involving testing, sampling, monitoring and/or analyzing downhole fluids.

Wellbores are drilled to locate and produce hydrocarbons. A downhole drilling tool with a bit at an end thereof is advanced into the ground to form a wellbore. As the drilling tool is advanced, drilling mud is pumped through the drilling tool and out the drill bit to cool the drilling tool and carry away cuttings. The fluid exits the drill bit and flows back up to the surface for recirculation through the drilling tool. The drilling mud is also used to form a mudcake to line the wellbore.

During a drilling operation, various downhole evaluations may be performed to determine characteristics of the wellbore and surrounding formations. In some cases, the drilling tool may be provided with devices to test and/or sample the surrounding formations and/or fluid contained in reservoirs therein. In some cases, the drilling tool may be removed and a downhole wireline tool may be deployed into the wellbore to test and/or sample the formations. These samples or tests may be used, for example, to determine whether valuable hydrocarbons are present.

Formation evaluation may involve drawing fluid from the formations into the downhole tool for testing and/or sampling. Various devices, such as probes or packers, may be extended from the downhole tool to establish fluid communication with the formations surrounding the wellbore and to draw fluid into the downhole tool. Downhole tools may be provided with fluid analyzers and/or sensors to measure downhole parameters, such as fluid properties. Examples of downhole devices are provided in U.S. Pat. No. 7,458,252, U.S. Pat. No. 8,024,125, U.S. Pat. No. 6,274,865, U.S. Pat. No. 6,301,959 and U.S. Pat. No. 8,322,416, the entire contents of which are hereby incorporated by reference herein.

SUMMARY

In one aspect, the disclosure relates to a method of evaluating a downhole fluid with a downhole tool. The downhole tool is positionable in a wellbore penetrating a subterranean formation, and has a probe positionable adjacent a wall of the wellbore and pumps. The probe has a sampling inlet and a contamination inlet to draw fluid from the formation into the downhole tool with the pumps. The method involves pumping fluid into the downhole tool through the sampling inlet and the contamination inlet, varying the pumping of the fluid through the sampling and contamination inlets at a plurality of flow rates, measuring parameters of the fluid passing through the sampling inlet and the contamination inlet (the fluid parameters comprising optical density), and determining cleanup of contamination during sampling by examining changes in optical density of the fluid entering the sampling inlet at the flow rates.

In another aspect, the disclosure relates to a method of evaluating a downhole fluid with a downhole tool. The downhole tool is positionable in a wellbore penetrating a subterranean formation, and has a probe positionable adjacent a wall of the wellbore and pumps. The probe has a sampling inlet and a contamination inlet to draw fluid from the formation into the downhole tool with the pumps. The method involves deploying the downhole tool into the wellbore, engaging the wellbore wall with the probe, pumping fluid into the downhole tool through the sampling inlet and the contamination inlet, varying the pumping of the fluid through the sampling and contamination inlets at a plurality of flow rates, measuring parameters of the fluid passing through the sampling inlet and the contamination inlet (the fluid parameters comprising optical density), and determining cleanup of contamination during sampling by examining changes in optical density of the fluid entering the sampling inlet at the flow rates.

In still another aspect, the disclosure relates to a method of evaluating a downhole fluid with a downhole tool. The downhole tool is positionable in a wellbore penetrating a subterranean formation, and has a probe positionable adjacent a wall of the wellbore and pumps. The probe has a sampling inlet and a contamination inlet to draw fluid from the formation into the downhole tool with the pumps. The method involves deploying the downhole tool into the wellbore, engaging the wellbore wall with the probe, pumping fluid into the downhole tool through the sampling inlet and the contamination inlet, varying the pumping of the fluid through the sampling and contamination inlets at a plurality of flow rates, measuring parameters of the fluid passing through the sampling inlet and the contamination inlet (the fluid parameters comprising optical density), determining cleanup of contamination during sampling by examining changes in optical density of the fluid entering the sampling inlet at the flow rates, and adjusting flow rates of the fluid through the sampling and contamination inlets until cleanup is achieved.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the method of formation evaluation are described with reference to the following figures. The same numbers are used throughout the figures to reference like features and components.

FIGS. 1.1 and 1.2 are schematic views, partially in cross-section, illustrating a wellsite with a downhole drilling tool and a downhole wireline tool, respectively, deployed into a wellbore for performing downhole formation evaluation in accordance with embodiments of the present disclosure;

FIGS. 2.1 and 2.2 are schematic views illustrating a portion of a downhole tool having an unfocused probe and a focused probe, respectively, for drawing downhole fluid therein in accordance with embodiments of the present disclosure;

FIGS. 3.1 and 3.2 are schematic views illustrating a downhole fluid passing into sampling and contamination inlets of a probe in a boundary case and a clean case, respectively, in accordance with embodiments of the present disclosure;

FIGS. 5.1 and 5.2 are graphs illustrating examples of optical measurements of downhole fluid entering sampling and contamination inlets as flow rate is varied at various stages of cleanup in accordance with embodiments of the present disclosure; and FIGS. 6.1 and 6.2 are flow charts illustrating methods of formation evaluation in accordance with embodiments of the present disclosure.

DETAILED DESCRIPTION

Figure 4:
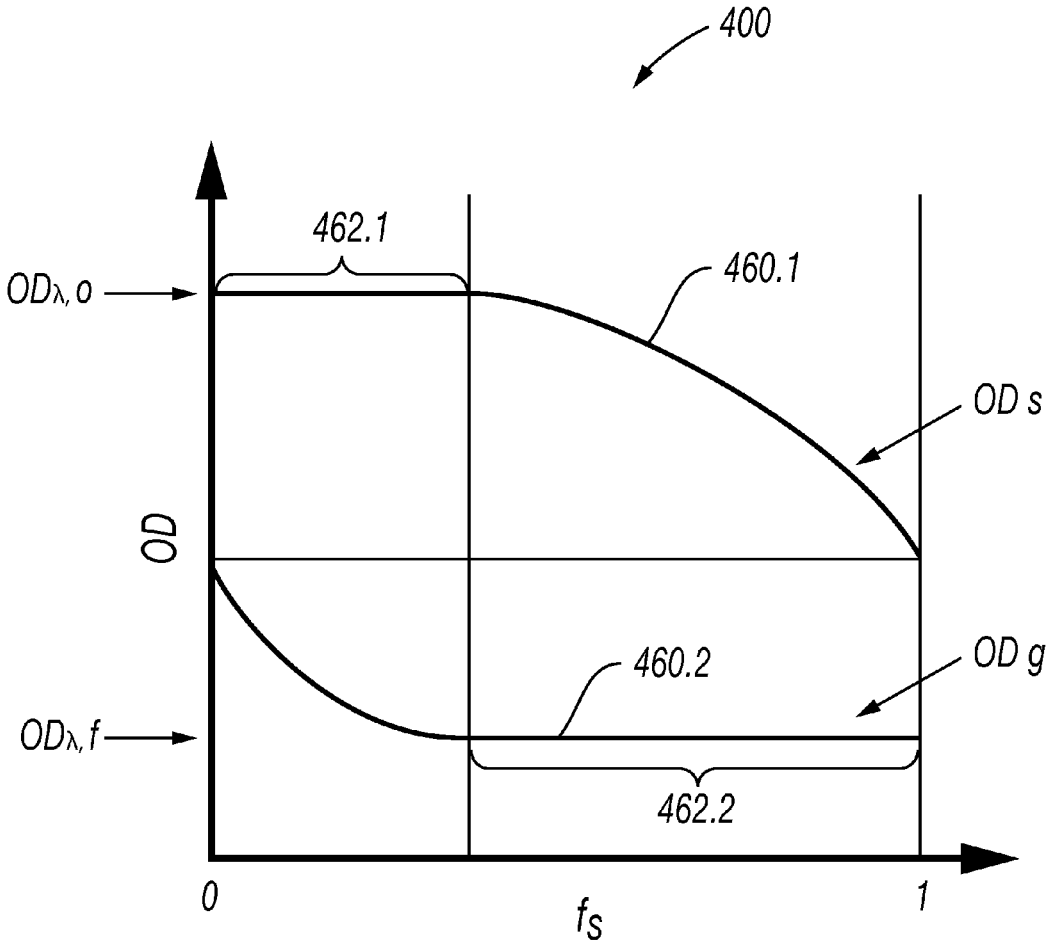
FIG. 4 is a graph illustrating optical measurements of downhole fluid entering sampling and contamination inlets in accordance with embodiments of the present disclosure.

The description that follows includes exemplary apparatuses, methods, techniques, and instruction sequences that embody techniques of the inventive subject matter. However, it is understood that the described embodiments may be practiced without these specific details.

The present disclosure relates to formation evaluation involving downhole fluid analysis. In particular, the disclosure describes methods for confirming that fluid entering a downhole tool is sufficiently clean (or virgin) fluid for formation evaluation. The downhole tool includes a probe with a sampling (or clean) inlet and a contamination (or guard) inlet. The probe is positioned along a wellbore wall to draw fluid into the inlets. A formation evaluation tool in the downhole tool monitors parameters, such as optical density, of the fluid entering the inlets. After flow through the inlets becomes stable, the flow of the fluid into the sampling and contamination inlets may be varied and analyzed. Optical density of the fluid entering the inlets at the varied flow rates may be measured to confirm that the fluid entering the sampling inlet is sufficiently clean for sampling.

'Formation evaluation' as used herein relates to the measurement, testing, sampling, and/or other analyses of wellsite materials, such as gases, fluids and/or solids. Such formation evaluation may be performed at a surface and/or downhole location to provide data, such as downhole parameters (e.g., temperature, pressure, permeability, porosity, etc.), material properties (e.g., viscosity, composition, density, etc.), and the like.

'Fluid analysis' as used herein relates to a type of formation evaluation of downhole fluids, such as wellbore, formation, reservoir, and/or other fluids located at a wellsite. Fluid analysis may be performed by a fluid analyzer capable of measuring fluid properties, such as viscosity, composition, density, optical density, temperature, pressure, flow rate, optical parameters, etc. Fluid analysis may be performed using, for example, optical sensors (e.g., spectrometers), gauges (e.g., quartz), densitometers, viscometers, resistivity sensors, nuclear sensors, and/or other fluid measurement and/or detection devices.

FIGS. 1.1 and 1.2 depict environments in which subject matter of the present disclosure may be implemented. FIG. 1.1 depicts a downhole drilling tool 10.1 and FIG. 1.2 depicts a downhole wireline tool 10.2 that may be used for performing formation evaluation. The downhole drilling tool 10.1 may be advanced into a subterranean formation F to form a wellbore 14. The downhole drilling tool 10.1 may be conveyed alone or among one or more (or itself may be) measurement-while-drilling (MWD) drilling tools, logging-while-drilling (LWD) drilling tools, or other drilling tools. The downhole drilling tool 10.1 is attached to a conveyor (e.g., drillstring) 16 driven by a rig 18 to form the wellbore 14. The downhole drilling tool 10.1 includes a probe 20 adapted to seal with a wall 22 of the wellbore 14 to draw fluid from the formation F into the downhole drilling tool 10.1 as depicted by the arrows.

The downhole drilling tool 10.1 may be withdrawn from the wellbore 14, and the downhole wireline tool 10.2 of FIG. 1.2 may be deployed from the rig 18 into the wellbore 14 via conveyance (e.g., a wireline cable) 16. The downhole wireline tool 10.2 is provided with the probe 20 adapted to seal with the wellbore wall 22 and draw fluid from the formation F into the downhole wireline tool 10.2. Backup pistons 24 may be used to assist in pushing the downhole wireline tool 10.2 and the probe 20 against the wellbore wall 22 and adjacent the formation F.

The downhole tools 10.1, 10.2 may also be provided with a formation evaluation tool 28 with a fluid analyzer 30 for analyzing the formation fluid drawn into the downhole tools 10.1, 10.2. The formation evaluation tool 28 includes a flowline 32 for receiving the formation fluid from the probe 20 and passing the fluid to the fluid analyzer 30 for analysis as will be described more fully herein.

A surface unit 34 may be provided to communicate with the downhole tool 10.1, 10.2 for passage of signals (e.g., data, power, command, etc.) therebetween. Outputs may be generated from the surface unit 34 based on the measurements collected by the formation evaluation tool 28 and/or the fluid analyzer 30. Such outputs may be in the form of data, measurements, reports, and/or other outputs.

While FIGS. 1.1 and 1.2 depict specific types of downhole tools 10.1 and 10.2, any downhole tool capable of performing formation evaluation may be used, such as drilling, coiled tubing, wireline or other downhole tool. Also, while FIGS. 1.1 and 1.2 depict a single probe 20, one or more probes, sets of dual packers and/or other fluid inlet devices may be used to draw fluid into the downhole tool for fluid analysis.

By positioning the fluid analyzer 30 in the downhole tool, real time data may be collected in situ at downhole conditions (e.g., temperatures and pressures where formation evaluation is performed) where downhole fluids are located. Fluids may also be evaluated at surface and/or offsite locations. In such cases, fluid samples may be taken to a surface and/or offsite location, and analyzed. Data and test results obtained from various locations and/or various methods and/or apparatuses may be analyzed and compared.

FIGS. 2.1 and 2.2 are schematic views depicting unfocused and focused sampling, respectively, of a formation. The probes 20.1, 20.2 may be extended from the downhole tools 10.1,10.2 for engagement with the wellbore wall 22. The probes 20.1, 20.2 are provided with a packer 36 for sealing with the wellbore wall 22. Packer 36 contacts the wellbore wall 22 and forms a seal with a mudcake 39 lining the wellbore wall 22.

A mud filtrate 39 of the mudcake seeps into the wellbore wall 22 and creates an invaded zone 40 about the wellbore 14. The invaded zone 40 contains contaminated fluid 43 including mud filtrate and other wellbore fluids that may contaminate surrounding formations, such as formation F, and a portion of clean formation fluid 42 in the formation F. A boundary 41 is defined between the contaminated fluid 43 and the clean fluid 42.

FIG. 2.1 depicts a portion of the downhole tool 10.1 with a probe 20.1 for unfocused sampling. FIG. 2.2 depicts a portion of the downhole tool 10.2 with a probe 20.2 for focused sampling. The probe 20.1 has a single inlet 44 for drawing fluid into the downhole tool 10.1. Downhole fluid flows into the downhole tool 10.1 through the single inlet 44 and into flowline 32 fluidly coupled thereto. The flowline 32 extends into the downhole tool 10.1 for transporting downhole fluid therethrough. A pump 52 and a valve 54 may be provided to manipulate fluid flow through the flowline 32.

The probe 20.2 of FIG. 2.2 has multiple inlets, namely sampling (or clean) inlet 44.1 and contamination (or guard) inlet 44.2. The contamination inlet 44.2 has a ring shaped defining a concentric circle about the sampling inlet 44.1. Downhole fluid flows into the downhole tool 10.2 through the sampling inlet 44.1 and the contamination inlet 44.2 in the probe 20.2. The sampling inlet 44.1 and the contamination inlet 44.2 are fluidly coupled to flowlines 32.1, 32.2, respectively, extending into the downhole tool 10.2 for transporting downhole fluid therethrough. Pumps 52.1, 52.2 and valves 54.1, 54.2 may be provided along flowlines 32.1, 32.2, respectively, to manipulate fluid flow therethrough.

While probes 20.1, 20.2 with inlets 44, 44.1, 44.2 are depicted in a specific configuration, one or more probes, dual packers and related inlets may be provided to receive downhole fluids and pass them to one or more flowlines 32, 32.1, 32.2. Examples of downhole tools and fluid communication devices, such as probes and packers, that may be used are depicted in U.S. Pat. No. 7,458,252 and U.S. Pat. No. 8,322,416, previously incorporated herein.

The downhole tools 10.1, 10.2 of FIGS. 2.1 and 2.2 may be provided with the formation evaluation tool 28 with a fluid analyzer 30 to analyze, test, sample and/or otherwise evaluate the downhole fluid. The fluid analyzer 30 is coupled to the flowlines 32, 32.1, 32.2 for receiving the downhole fluid. The fluid analyzer 30 may have an optical sensor 38 (e.g., spectrometer) and/or other measurement devices for measuring parameters of the downhole fluid. The fluid analyzer 30 may be, for example, an MIFA™ (Modular In situ Fluid Analyzer), LFA™ (Live Fluid Analyzer), LFA-pH™ (Live Fluid Analyzer with pH), OFA™ (Optical Fluid Analyzer), or CFA™ (Composition Fluid Analyzer) commercially available from SCHLUMBERGER TECHNOLOGY CORPORATIO (see www.slb.com).

One or more sensors S may optionally be provided to measure various downhole parameters and/or fluid properties. The sensor(s) may include, for example, gauges (e.g., quartz), densitometers, viscometers, resistivity sensors, nuclear sensors, and/or other measurement and/or detection devices capable of taking downhole data relating to, for example, downhole conditions and/or fluid properties.

A sample chamber 46 is also coupled to the flowlines 32, 32.1, 32.2 for receiving the downhole fluid. Fluid collected in the sample chamber 46 may be collected therein for retrieval at the surface, or may be exited through an outlet 48 in housing 50 of the downhole tools 10.1, 10.2. Optionally, flow of the downhole fluid into and/or through the downhole tool 10.1, 10.2 may be manipulated by one or more flow control devices, such as pumps 52, 52.1, 52.2, sample chamber 46, valves 54, 54.1, 54.2 and/or other devices. Optionally, a surface and/or downhole unit 34 may be provided to communicate with the formation evaluation tool 28, the fluid analyzer 30, and/or other portions of the downhole tools 10.1, 10.2 for the passage of signals (e.g., data, power, command, etc.) therebetween.

Contamination Analysis

Contamination analysis may be performed to understand and/or confirm sampling of clean fluid. The contamination analysis may be performed for unfocused sampling (e.g., as shown in FIG. 2.1) or focused sampling (e.g., as shown in FIG. 2.2). Theoretical and numerical modeling studies may be performed to understand fluid flow in the formation during sampling and/or the mechanisms of sample cleanup. Such studies may involve theoretical analysis and/or numerical modeling of cleanup.

Examples of contamination analysis involving sampling are provided in P. Hammond, One- and Two-Phase Flow during Fluid Sampling by a Wireline Tool, Transport in Porous Media 6: 299-330, (1991); A. Zazovsky, Monitoring and Prediction of Cleanup Production during Sampling, SPE 112409; A. Skibin et al., Self-Similarity in Contamination Transport to a Formation Fluid Tester during Cleanup Production, Transport in Porous Media 83: 55-72 (2010); Akram et al. (1999), Model to Predict Wireline Formation Tester Sample Contamination, SPE 59559 SPE Reservoir Eval. & Eng. 2 (6), 1999; O. Mullins et al. Real-Time Determination of Filtrate Contamination during Openhole Wireline Sampling by Optical Spectroscopy, SPE 63071; K. Hsu et al., Mulitchannel Oil-based Mud Contamination Monitoring Using Downhole Optical Spectrometer, SPWLA 49th Annual Logging Symposium, May 25-28, 2008; and U.S. Pat. No. 8,024,125 and U.S. Pat. No. 6,274,865.

The measured optical density at wavelength, λ, of a mixture of formation fluid and contaminant may be a weighted average of the optical densities of the individual components as follows:

$$OD(\lambda)=\eta OD_{contam}(\lambda)+(1-\eta)OD_{ff}(\lambda) \quad \text{Eqn. (1)}$$

where η is the fraction of contaminant in the mixture, $OD_{contam}(\lambda)$ is the optical density of contaminant at wavelength, λ, and $OD_{ff}(\lambda)$ is the optical density of formation fluid at wavelength, λ. This implies that the level of contamination may be estimated as follows:

$$\eta = \frac{OD_{ff}(\lambda) - OD(\lambda)}{OD_{ff}(\lambda) - OD_{contam}(\lambda)} \quad \text{Eqn. (2)}$$

In addition to measuring the optical density of the mixture, OD(λ), an estimate of the values of $OD_{contam}(\lambda)$ and $OD_{ff}(\lambda)$ may be determined. It may be assumed that $OD_{contam}(\lambda)$ is zero or very low. The optical density of the formation fluid at wavelength λ (or $OD_{ff}(\lambda)$) may be estimated by fitting an empirical model to the time series of measured values of OD(λ) as follows:

$$OD(\lambda)=OD_{ff}(\lambda)-\beta(\lambda)v^{-\gamma} \quad \text{Eqn. (3)}$$

where v is pumped volume and β,γ are variables whose values can be derived from a model fit to the measured data.

In focused sampling, dual flowlines with concentric inlets partition the flow in such a way as to concentrate the desired formation fluids in the sampling inlet 44.1 and contamination in the contamination inlet 44.2 as shown in FIG. 2.2. For focused sampling, the analysis used with unfocused sampling may use a 'synthetic' estimate of total flow into the probe by combining measurements made on the sampling inlet 44.1 and the contamination inlet 44.2 and weighting them by their relative flow rates.

Equations (1) to (3) above may be used to analyze the flow, and displaced volume may be a total displaced volume through both the sampling inlet 44.1 and the contamination inlet 44.2. The optical density, OD(λ), may be replaced by an effective optical density which is a weighted sum of the optical densities in the sampling inlet 44.1 and the contamination inlet 44.2 as follows:

$$OD(\lambda)=f_s OD_s(\lambda)+(1-f_s)OD_g(\lambda) \quad \text{Eqn. (4)}$$

where $f_s$ is the ratio of flow in the sampling inlet 44.1 to total flow, and $OD_s(\lambda)$, $OD_g(\lambda)$ are the measured optical densities at wavelength, λ, in the sampling inlet 44.1 and the contamination inlet 44.2, respectively.

FIGS. 3.1 and 3.2 schematically depict the flow of fluid into the downhole tool 10.2 of FIG. 2.2 over time. In particular, these figures show how fluid flows into the sampling inlet 44.1 and the contamination inlet 44.2 over time as contaminated fluid 43 in the invaded zone is pulled into the contamination inlet 44.2. The process of removing contaminated fluid in the invaded zone 40 until sufficiently clean fluid 42 enters the sampling inlet 44.1 is sometimes referred to as 'cleanup.'

Initially, during cleanup, both inlets 44.1, 44.2 receive contaminated fluid 43 until clean fluid breaks through as shown in FIG. 3.1. In this example, the boundary 41 has moved to an outer perimeter of the sampling inlet 44.1 such that clean fluid is entering the sampling inlet 44.1 and contaminated fluid is entering the contamination inlet 44.2.

The boundary 41 between fluid in the invaded zone 40 and clean fluid 42 aligns with a wall 45 between the sampling inlet 44.1 and the contamination inlet 44.2. Slightly increasing the flow into the sampling inlet 44.1 may cause fluid from the invaded zone 40 to enter the sampling inlet 44.1. Slightly decreasing the flow of fluid into the sampling inlet 44.1 may cause clean fluid to enter the contamination inlet 44.2 as shown in FIG. 3.2.

FIG. 3.2 shows an image of fluid flow from a formation being produced by a focused sampling system. This shows the expected flow pattern after cleanup has progressed to an advanced stage in which fluid from the uninvaded part of the formation is being reliably produced into the sampling inlet of the system. The optical properties (e.g., optical density) of the produced fluids in the sampling inlet 44.1 and the contamination inlet 44.2 may be measured at a number of wavelengths.

Flow rate $Q_s$ of downhole fluid into the sampling inlet 44.1 and flow rate Qg of downhole fluid into the contamination inlet 44.2 may be varied, for example by varying the pump rates of pumps 52.1, 52.2 (FIG. 2.2), respectively, such that contamination is drawn into the contamination inlet 44.2 and away from the sampling inlet 44.1. The boundary 41 may be varied by adjusting flow rates or waiting for sufficient cleanup over time. As shown in FIG. 3.2, the boundary 41 has shifted to a position along the contamination inlet 44.2 such that a portion of the clean fluid 42 is now also entering the contamination inlet 44.2. In this case, the downhole fluid entering the contamination inlet 44.2 is a mix of contaminated fluid from the invaded zone 40 and clean fluid 42.

Over time, the flow of downhole fluid into the sampling inlet 44.1 and the contamination inlet 44.2 may sufficiently stabilize to assure that only clean fluid 42 enters the sampling inlet 44.1. Flow patterns after cleanup and stabilization over time may progress to an advanced stage in which clean fluid 42 is being reliably produced into the sampling inlet 44.1. To assure cleanup has been achieved and stabilization has occurred, the formation evaluation tool 28 and/or the fluid analyzer 30 may be used to monitor parameters of the fluid entering the sampling inlet 44.1 and the contamination inlet 44.2. If the monitored parameters are consistent over time, it may be assumed that cleanup has been achieved. Confirmations may also be performed to verify cleanup has occurred as will be described more fully herein.

Stabilization may occur, for example, when the measurements of the downhole fluid entering the sampling inlet 44.1 and/or the contamination inlet 44.2 are sufficiently consistent. In another example, stabilization may occur when the fluid analyzer 30 (FIG. 2.2) measures fluid entering the sampling inlet 44.1 to be below a predetermined contamination level for a period of time. The removal of contamination may indicate that cleanup of the invaded zone 40 surrounding the formation has completed and breakthrough of clean (or virgin) fluid enters the downhole tool 10.2. Requirements for stabilization or cleanup may be determined by specification, operating requirements, client needs, etc.

Stabilization may indicate that the invaded zone 40 has been sufficiently removed to permit clean fluid 42 to enter the sampling inlet 44.1. The contamination inlet 44.2 may continue to draw contaminated fluid therein and prevent it from entering the sampling inlet 44.1. After stabilization, the optical density of the downhole fluid entering the sampling inlet 44.1 and the contamination inlet 44.2 may be measured and analyzed to confirm the downhole fluid entering the sampling inlet 44.1 is sufficiently contamination free and/or that cleanup has properly occurred.

Some insight into the completeness of the cleanup process may be obtained by observing how the optical density of the produced fluid in the sampling inlet 44.1 and the contamination inlet 44.2 change in response to the boundary 41 of flow in the sampling inlet 44.1 and the contamination inlet 44.2. After stabilization is reached such that cleanup has progressed to the stage that clean fluid 42 is consistently produced into the sampling inlet 44.1, optical density may be measured using the fluid analyzer 30 (e.g., in a color or methane channel) (FIG. 2.2).

FIG. 4 is a graph 400 of optical density (OD) (y-axis) versus flow fraction (L) (x-axis). The graph 400 may be generated, for example, by measuring downhole fluid entering the sampling inlet 44.1 and the contamination inlet 44.2 with the fluid analyzer 30 as shown in FIG. 2.2. The optical densities as shown are taken after sufficient fluid has been drawn into the downhole tool 10.2 to stabilize.

Referring to FIGS. 2.2 and 4, optical density may be measured by an optical sensor, such as optical sensor 38 of FIG. 2.2, to generate an optical density line 460.1 for the downhole fluid entering sampling inlet 44.1, and an optical density line 460.2 for the downhole fluid entering contamination inlet 44.2. Optical density for the sampling inlet 44.1 and the contamination inlet 44.2 may be measured at a variety of wavelengths.

In a model described herein, the optical density measured at one or more wavelengths is expected to change as shown in FIG. 4. Optical density of the clean fluid is depicted on the graph as $OD_{\lambda,o}$. The clean fluid may be, for example, a hydrocarbon (or oil) in a reservoir in the formation F (FIG. 2.2). Optical density of the fluid in the invaded zone is depicted on the graph as $OD_{\lambda,f}$, and may be a mix of hydrocarbons and contaminants. As shown, the optical density $OD_{\lambda,o}$ of clean fluid is greater than the optical density $OD_{\lambda,f}$ of contaminated fluid, but may be less or the same in some cases.

Flow fraction $f_s$ as shown in FIG. 4 may be determined from the flow rates of the fluid entering the sampling inlet 44.1. $Q_s$ is the volumetric flow rate in the sampling inlet; and $Q_g$ is the volumetric flow rate in the contamination inlet (FIG. 3.2). Flow fraction $f_s$, the ratio of the flow in the sampling inlet to the total flow, is fractional flow in the sampling inlet. This can be expressed as follows:

$$f_s = \frac{Q_s}{Q_s + Q_g} = 1 - \frac{Q_g}{Q_s + Q_g} \qquad \text{Eqn. (5)}$$

At the extremes of the graph 400 (e.g., at $f_s$=0, $f_s$=1), the flow enters the contamination inlet 44.2 or the sampling inlet 44.1, respectively. Assuming geometry of the inlets 44.1, 44.2 does not affect the flow (i.e., the inlets are small compared to the scale of the flow), then the same measured optical density is provided in both cases. Any difference can be an indication of the scale of the flow patterns present at this time. The flow fraction, $f_s$, is 1 when approximately all the fluid is being produced into the sampling inlet 44.1, and $f_s$=0 when all the fluid is being produced into the contamination inlet 44.2. At $f_s$=1, flow is directed into the sampling inlet 44.1.

Fluid entering the sampling inlet 44.1 will be a mixture of clean fluid 42 and contaminated fluid 43 as shown in FIG. 2.2. The measured optical density may be between the optical density $OD_{\lambda,o}$ of the clean fluid 42 and the optical density $OD_{\lambda,f}$ of the contaminated fluid 43. As a balance of flow between inlets 44.1, 44.2 is changed to decrease the flow fraction into the sampling inlet 44.1 and to increase the flow fraction into the contamination inlet 44.2 as shown in FIG. 3.1, the measured optical density $OD_s$ in the sampling inlet 44.1 changes as part of the contaminated fluid 43 of the invaded zone 40 enters the contamination inlet 44.2 and a concentration of clean fluid 42 in the sampling inlet 44.1 increases.

The optical density of the clean fluid 42 in the formation F may be different from the optical density of the contaminated fluid 43. In the example shown in FIG. 4, the optical density of the clean fluid 42 is greater than the optical density of the contaminated fluid 43. The analysis herein may be modified for cases in which the optical density of the contaminated fluid 43 is greater than the optical density of the clean fluid 42.

If all the fluid flow is directed into the sampling inlet 44.1 (at $f_s$=1), then the fluid in the sampling inlet 44.1 will be a mixture of clean fluid 42 and contaminated fluid 43. The measured optical density may be between the optical density of the clean fluid 42 and the optical density of the contaminated fluid 43. As the balance of flow is changed to decrease the flow fraction into the sampling inlet 44.1 and to increase the flow fraction into the contamination inlet 44.2, the measured optical density in the sampling inlet 44.1 may change as part of the contaminated fluid 43 of the invaded zone 40 enters the contamination inlet 44.2 and the concentration of clean fluid 42 in the sampling inlet 44.1 increases.

Other features in the flow fraction plot may provide information about the cleanup process. As shown in FIG. 4, an end of the optical density plateau 462.1 on the sampling inlet 44.1 corresponds to the start of an optical density plateau 462.2 on the contamination inlet 44.2. As the fractional flow changes, the repartition of fluid between the sampling inlet 44.1 and the contamination inlet changes. In the symmetrical model shown in FIG. 3.1, there may be some point at which all clean fluid 42 enters the sampling inlet 44.1 and all contaminated fluid 43 enters the contamination inlet 44.2. The boundary 41 between the contaminated fluid and the clean fluid aligns with the boundary between the sampling inlet 44.1 and the contamination inlet 44.2 as shown in FIG. 3.1. The flow fraction in the sampling inlet 44.1 may be slightly increased to cause contaminated fluid 43 to enter the sampling inlet 44.1. The flow fraction in the contamination inlet 44.2 may be slightly decreased to cause clean fluid 42 to enter the contamination inlet 44.2.

In a sampling operation, the boundary 41 of the invaded zone prior to sampling may not be parallel to the wellbore wall 22 (FIG. 2.2). The invasion may not be piston-like with a sharp contrast between contaminated fluid 43 and clean fluid 42. In some cases, a transition may be present with a concentration gradient. There may be inhomogeneities in the formation (e.g., fractures, permeability differences, etc.) which may prevent symmetry.

The existence of a gap between the optical density plateau 462.1 of the sampling inlet 44.1 and the optical density plateau 462.2 of the contamination inlet 44.2 may indicate an influence of one or more of the situations described above and may provide information about a possible cause.

FIG. 4 also shows that the optical density in the sampling inlet 44.1 at $f_s$=1 is the same as the optical density in the contamination inlet 44.2 at $f_s$=0. This is for the case in which the inlet geometry does not affect the flow pattern. At the extremes ($f_s$=0, $f_s$=1) all the fluid flow goes into the contamination inlet 44.2 or the sampling inlet 44.1, respectively. If the inlet geometry does not affect the flow (i.e., the inlets are small compared to the scale of the flow), then the same fluid may flow into the sampling inlet 44.1 or the contamination inlet 44.2, respectively. The same optical density may be measured in both cases. Any difference in optical densities of the sampling inlet 44.1 and the contamination inlet 44.2 may be an indication of the scale of the flow patterns present at this time.

As illustrated in FIG. 4, flow may correspond to an equilibrium state of flow after a particular flow fraction has been established for a sufficient period of time. When the flow fraction is changed, the optical density response may not be immediate; the flow pattern may evolve from an initial state to a state corresponding to a new flow fraction. A new equilibrium can be observed after sufficient time during which the transient state may stabilize. The amount of time for stabilization or the amount of fluid to be displaced can be an indication of a volume of formation influenced by a flow pattern into the sampling inlet 44.1 and the contamination inlet 44.2.

When a point is reached at which all the fluid in the invaded zone 40 enters the contamination inlet 44.2 and only clean fluid 42 enters the sampling inlet 44.1 as shown in FIG. 3.2, then the measured optical density stabilizes and remains constant for flow fractions below this point. Conversely, as fluid flow into the contamination inlet 44.2 is increased, initially fluid from the invaded zone 40 enters and the measured optical density remains constant. When the flow fraction $f_s$ reaches the point at which clean fluid 42 starts to enter the contamination inlet 44.2 as shown in FIG. 3.2, the optical density $OD_s$ begins to change as a function of flow fraction $f_s$.

Observing the stabilization of optical density in the sampling inlet 44.1 and the contamination inlet 44.2 at the limiting flow fractions serves to indicate that the cleanup has progressed correctly according to the model described herein. In particular, if an optical density plateau 462.1, shown as a flat portion of the line 460.1 of FIG. 4, in the sampling inlet 44.1 is not observed, this may indicate that there is a problem with the cleanup and that an uncontaminated sample may not be possible. This may occur, for example, if invasion is very deep and/or not piston-like (i.e., a mix of clean fluid and contaminated fluid exists a distance (e.g., far) from the wellbore wall). Other possible influences may be the presence of fractures (natural or drilling-induced) which divert fluid flow in a manner different from that needed for proper cleanup, or continuous re-invasion. By performing an analysis of the behavior of the measured optical density, it may be possible to determine a cause.

In order to verify that the cleanup has proceeded as expected and to analyze possible problems (e.g., possible entry of contaminated fluid into the sampling inlet), changes in the optical density of the produced fluid and changes in the relative flow in the sampling inlet 44.1 and the contamination inlet 44.2 may be observed. This can be achieved by changing the speed of the pumps (e.g., 52.1, 52.2) in the sampling inlet 44.1 and the contamination inlet 44.2 or by other appropriate means, such as throttling.

In connection with the sampling operation, an estimate of the contaminant concentration in the produced fluid may be made to ensure that the sample quality is sufficient for the desired needs. After cleanup, changes in operating procedure during and/or at the end of the cleanup phase of the operation may be used to obtain more information about fluid flow in the formation at this time and to diagnose problems with the estimation of contamination levels in the produced fluid.

FIGS. 5.1 and 5.2 show an example focused flow check that may be performed to confirm sufficient cleanup for obtaining a sample of adequate quality for sampling. The check may be performed using, for example, the downhole unit 34 and measurements collected by the formation evaluation tool 28 and/or the fluid analyzer 30 of FIG. 2.2. As depicted in FIG. 4, optical density may be measured by the optical sensor 38 (FIG. 2.2) to generate the desired output. FIG. 5.1 shows an example graph 500.1 demonstrating insufficient cleanup of the fluid entering sampling inlet 44.1. FIG. 5.2 shows an example graph 500.2 demonstrating sufficient cleanup of the fluid entering the sampling inlet 44.1.

FIGS. 5.1 and 5.2 show graphs 500.1, 500.2 of optical density (OD) (y-axis) versus flow fraction ($f_s$) (x-axis) of fluid entering the sampling inlet 44.1 and the contamination inlet 44.2 of FIG. 3.2. FIG. 5.1 shows optical density line 546.1.1 for the fluid entering the sampling inlet 44.1, and optical density line 546.2.1 for the fluid entering the contamination inlet 44.2. FIG. 5.2 shows optical density line 546.2.1 for the fluid entering the sampling inlet 44.1, and optical density line 546.2.2 for the fluid entering the contamination inlet 44.2.

Optical densities along each of the lines 546.1.1-546.2.2 are depicted at various flow rates $f_s$ i-vi. The flow rate of the fluid into the sampling inlet 44.1 and the contamination inlet 44.2 may be varied, for example, by varying the pump rate of pumps 55.1, 55.2 of FIG. 2.2. In the example of FIG. 5.1, the pump rate is varied from flow rate $f_s$ i-iv, resulting in a change in the optical density in lines 546.1.1, 546.2.1 at each of the flow rates.

The optical density in the sample inlet 44.1 and the optical density in the contamination inlet 44.2 at the varied flow rates may be examined to determine if cleanup is achieved. A change of OD at the different flow fractions as shown in FIG. 5.1 indicates insufficient cleanup of the fluid entering the sampling inlet 44.1. If a focused flow rate check is performed before cleanup (i.e., sufficient contaminated fluid 43 has not been displaced to allow only clean fluid 42 to enter the sample probe 20), then the optical density at different relative flow rates may not stabilize. For example, in FIG. 5.1, if an initial pumpout is performed at a relative flow rate, $f_s$ i, and pumpout flow rates are set to monitor other relative flow rates, $f_s$ ii, $f_s$ iii and $f_s$ iv, then the optical density may be different at each point. If an observation is repeated at a given relative flow rate (e.g., $f_s$ v being the same as $f_s$ ii), then a different optical density may be observed at a later time because the relative mix of clean fluid 42 and contaminated fluid 43 has not stabilized.

FIG. 5.2 illustrates a case where cleanup has progressed to the point that relative flow rates at which only clean fluid 42 is produced into the sampling inlet 44.1. In the example of FIG. 5.2, the pump rate is varied from flow rate $f_s$ i through $f_s$ vi, resulting in a constant optical density in line 546.2.1 at each of the flow rates. The constant OD at the different flow fractions indicates sufficient cleanup of the fluid entering the sampling inlet 44.1. In the example of FIG. 5.2, it may be assumed that cleanup has been done at a relative flow rate $f_s$ i (i.e., ratio of sample flow rate to total flow rate). Additional relative flow rates $f_s$ ii may be selected, and set the pumps 55.1, 55.2 to attain this rate. The observed fluid optical density or other physical properties may change as shown to new values representative of the relative flow rate at point $f_s$ ii. Changes may not be instantaneous, and may take some time for fluid to move through the tool during sampling and/or as changes in relative flow rates propagate into the formation and change the flow pattern around the inlets 44.1, 44.2 (FIG. 2.2).

When changes in fluid properties at the new flow rate are stable, the additional relative flow rates $f_s$ iii and $f_s$ iv may be attempted. The example data shown in FIG. 5.2 indicates that at relative flow rates below point $f_s$ ii, clean fluid 42 is produced into the sampling inlet 44.1. Sampling may be safely conducted at any flow rate below point $f_s$ ii. Somewhere between the relative flow rates of $f_s$ ii and $f_s$ i, contaminated fluid 43 may be drawn into the sampling inlet 44.1. Additional relative flow rates in this region, such as $f_s$ v and $f_s$ vi, may be selected to know with more resolution the relative flow rate where contaminated fluid 43 starts to be produced. In the example shown, the optical density in the sampling inlet 44.1 at relative flow rate, $f_s$ v, may be the same as at $f_s$ ii, $f_s$ iii, $f_s$ iv so no contamination fluid 43 is drawn into the probe 20. The optical density changes between $f_s$ v and $f_s$ vi, thereby indicating that contaminated fluid 43 has started to be produced into the sampling inlet 44.1.

FIGS. 6.1 and 6.2 show example methods 600.1 and 600.2 of evaluating a downhole fluid. The method 600.1 involves 660—lowering a downhole tool into a wellbore and 661—setting the downhole tool at a test depth (see, e.g., FIGS. 1.1 and 1.2), 662—optionally performing a pretest, 664—pumping fluid through a sampling inlet and a contamination inlet of the downhole tool (see, e.g., FIG. 2.2), 665—observing fluid properties on the sampling inlet and the contamination inlet to monitor progress of cleanup (see, e.g., FIG. 4), and 667—optionally performing focused flow-monitoring while cleanup is in progress. The method 600.1 may also involve a focused flow rate check in a confirmation loop 678 to verify cleanup is complete. The confirmation loop 678 includes 668—observing fluid properties while pumping, 670—performing a flow monitoring check, 672—confirming cleanup and ready for sampling, 674—taking a sample, and 676—taking an additional sample. The loop 678 may be repeated to confirm cleanup is achieved.

The method 600.2 involves 680—deploying a downhole tool into a wellbore, 682—engaging a wall of the wellbore with a probe of the downhole tool, 684—pumping fluid into the downhole tool through a sampling inlet and a contamination inlet of the probe, 686—varying the pumping of the fluid through the sampling inlet and the contamination inlet at a plurality of flow rates, 688—measuring parameters (e.g., optical density) of the fluid entering the sampling inlet and the contamination inlet, and 690—determining cleanup of contamination during sampling by determining changes in optical density of the fluid entering the sampling inlet at various flow rates. The method 600.2 may also include 692—adjusting the flow rates of the fluid entering the sampling and contamination inlets until cleanup is achieved. The adjusting 692 may involve adjusting and/or optimizing flow of clean fluid into the sampling inlet by adjusting the flow rate of the fluid through the sampling inlet. The adjusting 692 may be performed such that contamination of the fluid entering the sampling inlet is below a predetermined maximum for a predetermined time.

The method may also involve performing a pretest, setting the downhole tool in the wellbore, monitoring fluid properties, collecting fluid samples, and measuring downhole parameters. The method may be performed in any desired order and repeated in part or in whole as desired.

In an example sequence of operation, the downhole tool is lowered into the wellbore and positioned at the depth at which a sample is desired, and the probe pressed into sealing engagement with the wall of the wellbore (see, e.g., FIGS. 1.1 and 1.2). A pretest may be performed to check sealing of probe 20 against the wellbore wall 22, to determine if the formation F is permeable, and/or to measure downhole parameters, such as formation pressure.

Pumping is then commenced to initiate flow of fluid from the formation. As shown in FIG. 2, the fluid initially produced may be a mixture of contaminated fluid 43 and clean fluid 42 from the formation. The contaminated fluid 43 may be dominant at the early stages of pumpout until breakthrough is achieved. In the case of focused sampling involving the sampling inlet 44.1 and the contamination inlet 44.2, there may be a pump (or pumpout module) 55.1 on the sampling inlet 44.1 and another pump (or pumpout module) 55.2 on the contamination inlet 44.2 as shown in FIG. 3.2. The pumps 55.1, 55.2 (FIG. 2.2) may be individually controlled to determine the flow rate or pressure drawdown on the sampling inlet 44.1 and the contamination inlet 44.2.

Pumping may be continued for a sufficient time to increase the amount of clean fluid 42 being displaced relative to the amount of contaminated fluid 43. When a sufficient quantity has been displaced, it may be possible to produce clean fluid 42 into the sample probe 20 while producing a mixture of clean fluid 42 and contaminated fluid 43 into the contamination inlet 44.2 as shown in FIG. 3.2. During this time, the optical density and/or other physical properties of the fluid may be observed in order to monitor progress of cleanup. A check for consistency of the optical density at various flow rates may be used to confirm cleanup.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method of evaluating a downhole fluid with a downhole tool, the downhole tool positionable in a wellbore penetrating a subterranean formation, the downhole tool having a probe positionable adjacent a wall of the wellbore and pumps, the probe having a sampling inlet and a contamination inlet to draw fluid from the subterranean formation into the downhole tool with the pumps, the method comprising:

pumping the fluid into the downhole tool through the sampling inlet and the contamination inlet;

varying the pumping of the fluid through the sampling inlet and the contamination inlet at a plurality of flow fractions;

measuring parameters of the fluid passing through the sampling inlet and the contamination inlet, the fluid parameters comprising optical density; and determining cleanup of contamination during sampling by examining changes in the optical density of the fluid entering the sampling inlet at the plurality of flow fractions wherein determining is performed after stabilization, wherein the stabilization comprises verifying that the optical density is constant at different flow fractions, and wherein verifying is performed at the same as at least one of the different flow fractions.

2. The method of claim 1, further comprising repeating varying and measuring until the contamination remains below a predetermined amount for a predetermined time.

3. The method of claim 1, further comprising sampling the fluid.

4. The method of claim 1, wherein the changes in the optical density of the fluid entering the sampling inlet remains below a maximum variation.

5. The method of claim 1, wherein the fluid drawn into the downhole tool comprises a clean fluid and a contaminated fluid having a boundary therebetween, the boundary positioned adjacent the contamination inlet such that clean fluid flows into the sampling inlet and both the clean fluid and the contaminated fluid flow into the contamination inlet.

6. The method of claim 1, wherein the optical density of the fluid increases as contamination decreases and the optical density of the fluid decreases as contamination increases.

7. The method of claim 1, wherein at least two of pumping, measuring and varying are performed simultaneously.

8. The method of claim 1, further comprising adjusting the plurality of flow fractions of the fluid through the sampling and contamination inlets until cleanup.

9. The method of claim 1, further comprising monitoring fluid parameters.

10. A method of evaluating a downhole fluid with a downhole tool positionable in a wellbore penetrating a subterranean formation, the method comprising:

deploying the downhole tool into the wellbore, the downhole tool having a probe positionable adjacent a wall of the wellbore and pumps, the probe having a sampling inlet and a contamination inlet to draw fluid from the subterranean formation into the downhole tool with the pumps;

engaging the wellbore wall with the probe;

pumping the fluid into the downhole tool through the sampling inlet and the contamination inlet;

varying the pumping of the fluid through the sampling inlet and the contamination inlet at a plurality of flow fractions;

measuring parameters of the fluid passing through the sampling inlet and the contamination inlet, the fluid parameters comprising optical density; and determining cleanup of contamination during sampling by examining changes in optical density of the fluid entering the sampling inlet at the plurality of flow fractions, wherein determining is performed after stabilization, wherein the stabilization comprises verifying that the optical density is constant at different flow fractions, and wherein verifying is performed at the same as at least one of the different flow fractions.

11. The method of claim 10, further comprising setting the downhole tool.

12. The method of claim 10, further comprising performing a pretest.

13. The method of claim 10, further comprising collecting a sample of the fluid.

14. The method of claim 10, wherein deploying comprises positioning the downhole tool at a desired depth in the wellbore.

15. The method of claim 14, wherein deploying comprises moving the downhole tool to another desired depth.

16. A method of evaluating a downhole fluid with a downhole tool, the downhole tool positionable in a wellbore penetrating a subterranean formation, the downhole tool having a probe positionable adjacent a wall of the wellbore and pumps, the probe having a sampling inlet and a contamination inlet to draw fluid from the subterranean formation into the downhole tool with the pumps, the method comprising:

pumping the fluid into the downhole tool through the sampling inlet and the contamination inlet;

varying the pumping of the fluid through the sampling inlet and the contamination inlet at a plurality of flow fractions;

measuring parameters of the fluid passing through the sampling inlet and the contamination inlet, the fluid parameters comprising optical density;

determining cleanup of contamination during sampling by examining changes in optical density of the fluid entering the sampling inlet at the plurality of flow fractions, wherein determining is performed after stabilization, wherein the stabilization comprises verifying that the optical density is constant at different flow fractions, and wherein verifying is performed at the same as at least one of the different flow fractions; and adjusting the plurality of flow fractions of the fluid through the sampling and contamination inlets until cleanup.

17. The method of claim 16, further comprising optimizing cleanup by maintaining contamination entering the sampling inlet below a predetermined maximum.

18. The method of claim 16, further comprising sampling the fluid.

19. The method of claim 18, further comprising optimizing sampling by selectively adjusting a sampling flow rate in the sampling inlet.

* * * * *